US005419430A

United States Patent [19]

Wilson et al.

[11] Patent Number: 5,419,430

[45] Date of Patent: May 30, 1995

[54] PRESERVED FOOD CONTAINER AND DRUM

[75] Inventors: Diana J. Wilson, North Vancouver; David Hornblow, Vancouver; Peter Hickey, West Vancouver, all of Canada

[73] Assignee: Pacific Salmon Industries Inc., Surrey, Canada

[21] Appl. No.: 24,237

[22] Filed: Feb. 26, 1993

[51] Int. Cl.[6] ..... B65D 77/00; B65D 45/32; G10D 13/02

[52] U.S. Cl. ..... 206/216; 84/411 R; 220/320; 220/622; 220/680; 220/692; 426/104

[58] Field of Search ..... 206/216; 220/611–613, 220/622, 624, 625, 680, 692, 693, 319, 320; 84/411 R–420; 426/104, 112, 110; 446/408, 418

[56] References Cited

U.S. PATENT DOCUMENTS

| | | | |
|---|---|---|---|
| 937,323 | 10/1909 | McConaghy | 446/418 |
| 1,526,396 | 2/1925 | Tandy | 220/320 |
| 2,146,190 | 2/1939 | Luke | 220/320 X |
| 2,850,156 | 9/1958 | Shane | 84/411 R X |
| 3,055,253 | 9/1962 | Loughborough | 84/411 R |
| 3,270,871 | 9/1966 | Pushkin | 220/319 X |
| 5,099,607 | 3/1992 | Lawton | 220/692 X |
| 5,248,081 | 9/1993 | Hook | 426/110 X |

FOREIGN PATENT DOCUMENTS

| | | | |
|---|---|---|---|
| 0006735 | of 1908 | United Kingdom | 84/420 |
| 0141538 | 4/1920 | United Kingdom | 84/420 |
| WO8803352 | 5/1988 | WIPO | 220/680 |

*Primary Examiner*—Bryon P. Gehman
*Attorney, Agent, or Firm*—Christensen, O'Connor, Johnson & Kindness

[57] ABSTRACT

A container (10) includes a hoop (14) defining first and second open faces (16, 18). A flexible membrane (20) is secured tautly to the hoop to cover the first open face, whereby the flexible membrane serves as a percussion drum head and the hoop and flexible membrane cooperatively define a cavity (22) for receiving articles (24). A removable lid (26) selectively covers the second open face.

5 Claims, 6 Drawing Sheets

PRESERVED FOOD CONTAINER AND DRUM

FIELD OF THE INVENTION

The present invention relates to packaging, and more particularly to packaging for preserved foodstuff.

BACKGROUND OF THE INVENTION

Preserved foods are often sold in gift boxes of various shapes, including cylindrical boxes and tins. Typically the only utility for such containers is use for storing the foodstuff or other articles.

It is also known to make percussion drums by stretching wetted animal hide over a cylindrical hoop to form a drum head. Such craft work has long been practiced, for instance, by various aboriginal groups, including those tribes that are native to the North American continent.

SUMMARY OF THE INVENTION

The present invention is directed to a container that also serves as a percussion drum. The container is formed from: a hoop defining first and second open faces; a flexible membrane secured tautly to the hoop to cover the first open face, whereby the flexible membrane serves as a percussion drum head and the hoop and flexible membrane cooperatively define a cavity; and a removable lid for selectively covering the second open face, thereby closing the cavity.

In a further aspect of the present invention, a process for packaging preserved foodstuff in a container includes: forming a hoop defining first and second open faces; securing a flexible membrane tautly to the hoop to cover the first open face, whereby the flexible membrane serves a percussion drum head and the hoop and flexible membrane cooperatively define a cavity; placing foodstuff or other articles in the cavity; and covering the second open face with a removable lid.

The present invention thus provides an article of manufacture that is not only a serviceable percussion drum, but which also serves as a decorative gift container for containing preserved foodstuff or other articles.

BRIEF DESCRIPTION OF THE DRAWINGS

The foregoing aspects and many of the attendant advantages of this invention will become more readily appreciated in view of the following detailed description, when taken in conjunction with the accompanying drawings, wherein.

DETAILED DESCRIPTION OF THE PREFERRED EMBODIMENT

Figure 1:
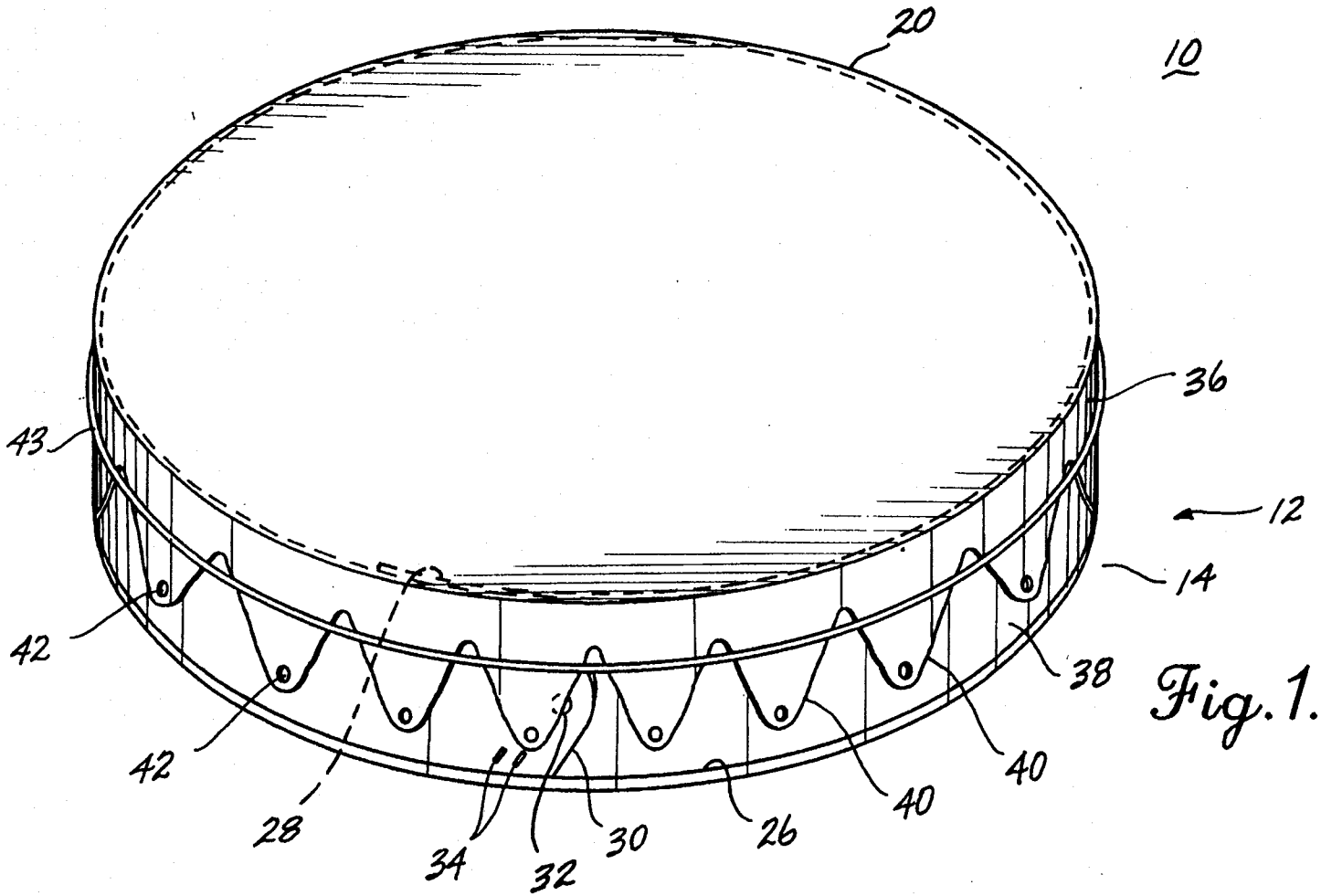
FIG. 1 is a perspective view of a container constructed in accordance with the present invention, in the closed configuration.
Figure 2:
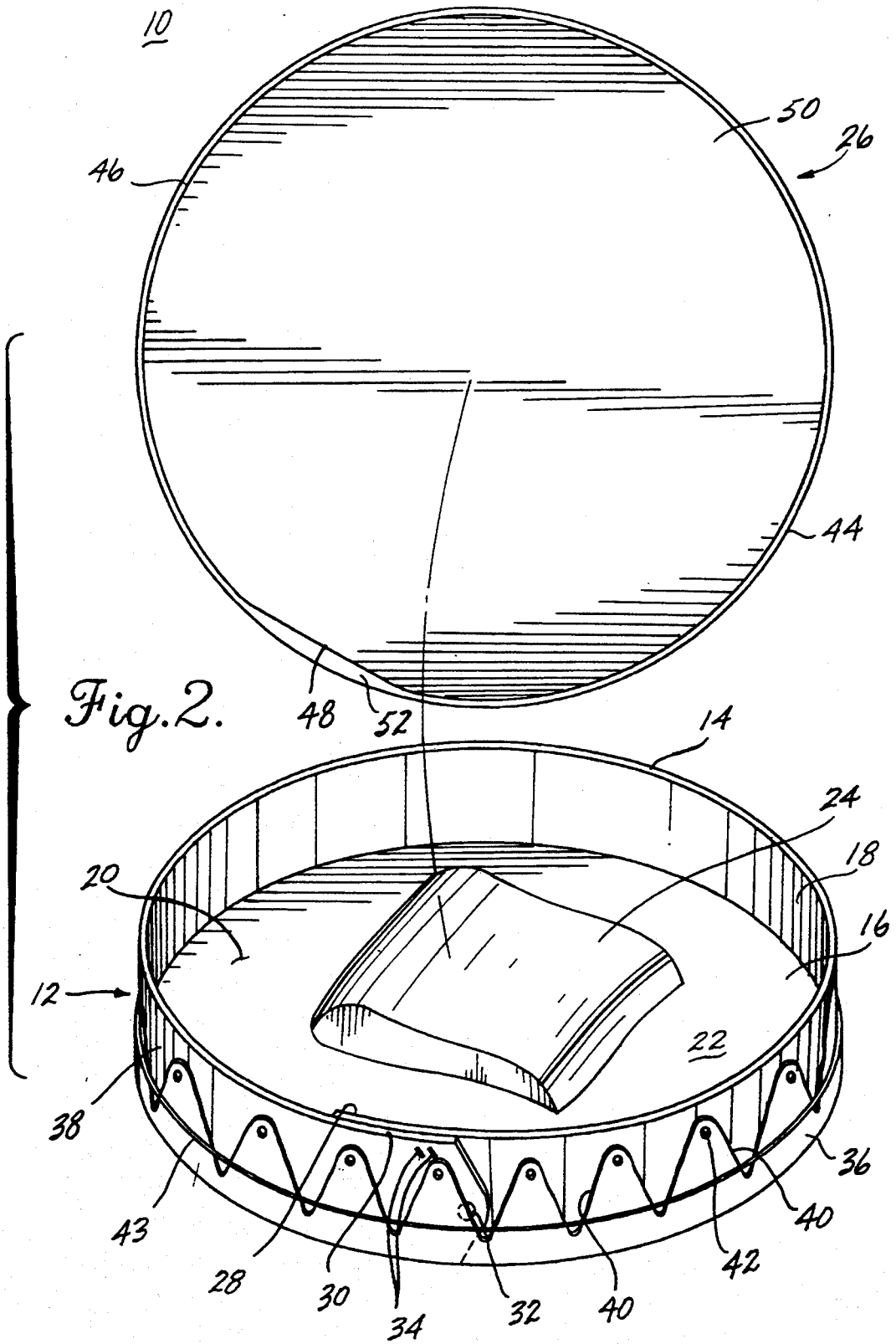
FIG. 2 is a perspective view of the container of FIG. 1 in the open configuration.

A container 10 constructed in accordance with the present invention is shown in FIGS. 1 and 2. The container 10 includes a drum portion 12 constructed from a hoop 14 that defines a first open face 16 and a second open face 18 (FIG. 2). The drum portion 12 further includes a flexible membrane 20 secured tautly to the hoop 14 to cover the first open face 16, whereby the flexible membrane 20 serves as a drum head and the hoop 14 and the flexible membrane 20 cooperatively define a cavity 22 for receiving foodstuff 24 or other articles. The container 10 further includes a removable lid 26 for selectively covering the second open face 18, thereby closing the cavity 22 and containing the foodstuff 24 or other articles.

Figure 3:
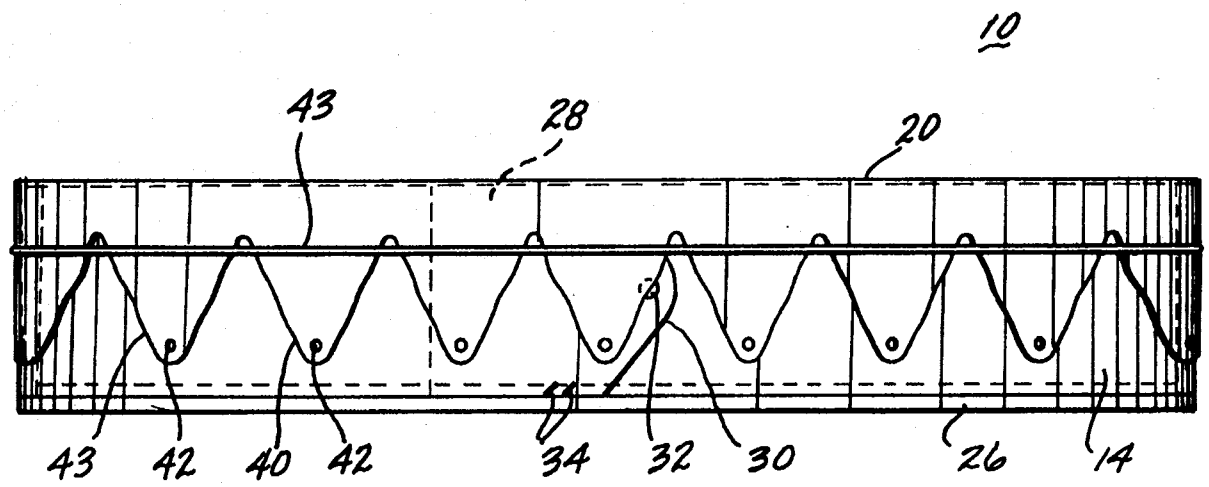
FIGS. 3, 4, and 5 are side elevational, top plan, and bottom plan views, respectively, of the container of FIG. 1.

Referring to FIGS. 1–3, the hoop 14 is constructed from an elongate strip having a first squared off end 28 and a second radiused end 30. The strip is wrapped to form the cylindrical hoop 14 by overlapping the second end 30 over the first end 28. The long edges of the hoop 14 thus define the first and second open faces 16 and 18, respectively. As used herein throughout, "hoop" refers to a frame structure defining a central aperture, and may be either cylindrical or have other rectilinear or curved geometric configurations, such as hexagonal, octagonal, oval or square configurations.

The second end 30 of the strip is preferably secured to the first end 28 by fasteners. In the preferred embodiment of FIGS. 1–3, a rivet 32 is installed through the overlapped ends 28 and 30 proximate the center of the second radiused end 30. Additionally, two staples 34 are also used to secure the overlapped ends 30 and 28. The staples 34 are spaced arcuately away from the radial tip of the second end 30 of the strip, and are also spaced away from the rivet 32 in a direction parallel to the longitudinal axis of the cylindrical hoop 14. Use of two fasteners, i.e., the rivet 32 and the staples 34, serves to prevent pivoting of the second end 30 relative to the first end 28 of the hoop 14.

The hoop 14 is preferably constructed from a strip of one-sixteenth inch plywood. However, hardboard, thermoplastic, reinforced thermosetting plastic, or other semi-rigid, bendable material may also be utilized. While the use of fasteners as described above is a preferred method of securement, other methods such as adhesion of the overlapped ends, or formation of the hoop from a one-piece plastic molding, are also possible.

The membrane 20 consists of a circular sheet of a flexible material. In a preferred embodiment, the membrane 20 is formed from deer skin. However, it will be readily apparent to those of skill in the art that other pliable material may be utilized, such as other leathers, synthetic suedes and leathers, parchment skin, flexible synthetic plastics such as cloth reinforced polyvinylchloride, parchment paper, or woven fabrics such as polyamide cloth. The membrane 20 is cut to a diameter larger than the diameter of the hoop 14, thereby having an edge portion 36 that extends radially past the first open face 16 of the hoop 14.

The edge portion 36 of the membrane 20 is folded downwardly to overlap and cover a portion of the exterior surface 38 of the hoop 14. The edge portion 36 of the membrane 20, when installed on the drum portion 12, has an undulating contour, defining a series of radially tapered points 40. An aperture 42 is formed through the tip of each point 40. The process of formation of these points 40 and the purpose of the apertures 42, will be described subsequently.

The edge portion 36 of the membrane 20 is secured to the exterior surface 38 of the hoop 14. In the preferred embodiment, the edge portion 36 is secured with an adhesive, such as a cyanoacrylate adhesive. Additionally, a cord 43 is wrapped around the folded edge portion 36 of the membrane 20 and is tightly tied. The cord 43 may be formed from a narrow strip of the same material used for the membrane 20, a strip of rawhide, or a woven material. The cord 43 serves to further secure the edge portion 36 of the membrane 20, and also has a decorative purpose. As installed, the membrane 20 is very taut, forming a percussion drum head. The drum portion 12 may be beaten with sticks or hands, as is customary.

Referring to FIG. 2, the membrane 20 and hoop 14 also form the internal cavity 22 of the container 10. This cavity may be used to store preserved foodstuff, such as dried salmon. However, it should be readily apparent that many other types of foodstuff or articles can be stored in the cavity 22, such as candies or sewing supplies.

The container 10 is completed and closed by the lid 26. The lid 26 has a disk configuration, being formed from a flat sheet of material that is cut or otherwise formed to a circular shape. Referring to FIGS. 2 and 3, the lid 26 has a stepped outer perimeter. At its widest point, the outer perimeter of the lid 26 defines an annular shoulder 44. The diameter of the annular shoulder 44 is the same as the outer diameter of the hoop 14. Thus, the shoulder 44 is larger than the diameter of the second open face 18. At its narrowest point, the outer perimeter of the lid 26 defines an annular rim 46, which is sized to correspond to, but to be slightly smaller than, the diameter of the second open face 18. When the lid 26 is installed, the rim 46 is received with the second open face 18 while the shoulder 44 abuts the adjacent long edge of the hoop 14.

Figure 4:
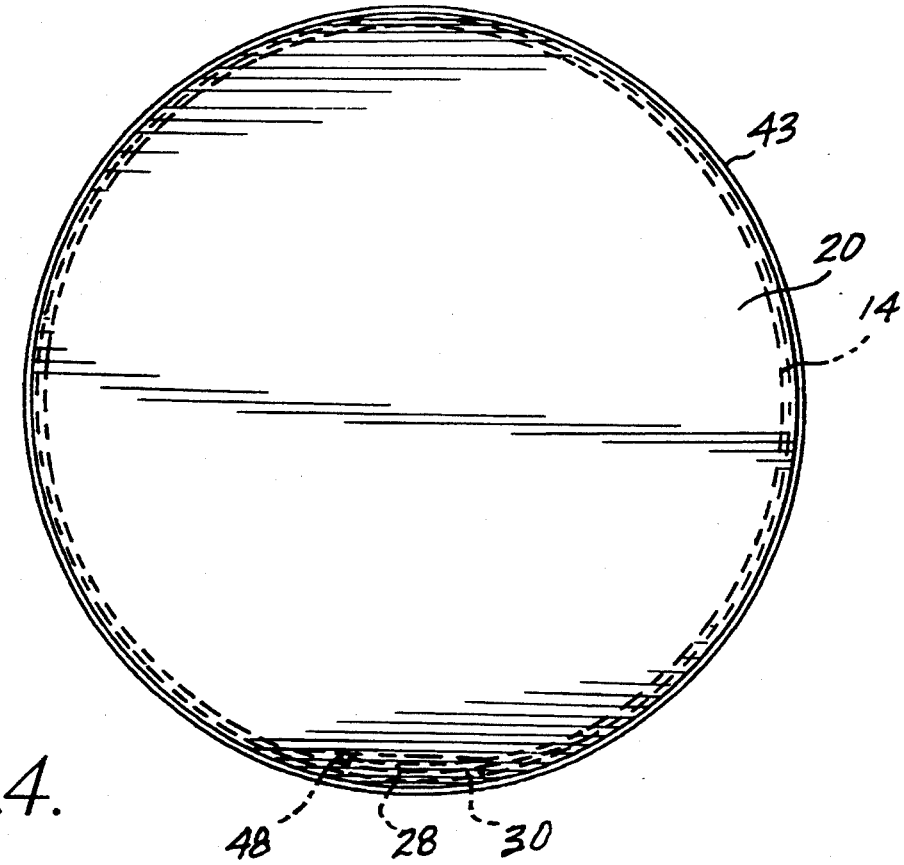
Figure 5:
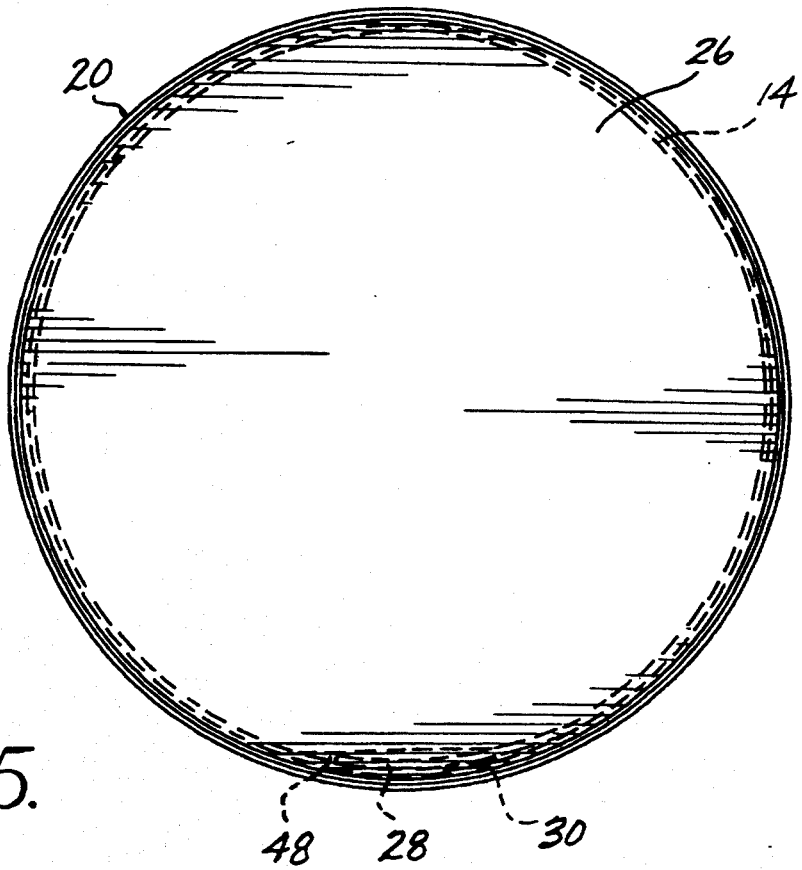

The overlap of the first end 28 and second end 30 of the hoop 14 creates a break in the regularity of the circular second open face 18 defined by the hoop 14 (FIGS. 4 and 5). The lid 26 is keyed to accommodate this overlap. In particular, a flat spot 48 is formed in the annular rim 46 of lid 26. This flat spot 48 provides sufficient clearance for the overlapped joint of the hoop 14.

When the lid 26 is installed on the container 10, as shown in FIGS. 1 and 3, the rim 46 of the lid 26 prevents substantial movement of the lid 26 in the direction of a plane defined by the second open face 18. Additionally, the key defined by the flat spot 48 of the lid 26 serves to prevent rotation of the lid 26 relative to the drum portion 12.

In the preferred embodiment illustrated, the lid 26 is formed by laminating two thin sheets of material, such as plywood (FIG. 2). An inner sheet 50, the perimeter of which defines the rim 46, is positioned centrally on a larger outer sheet 52, the perimeter of which defines the shoulder 44. The sheets 50 and 52 are secured in this position by use of an adhesive or other customary means, such as stapling.

Figure 6:
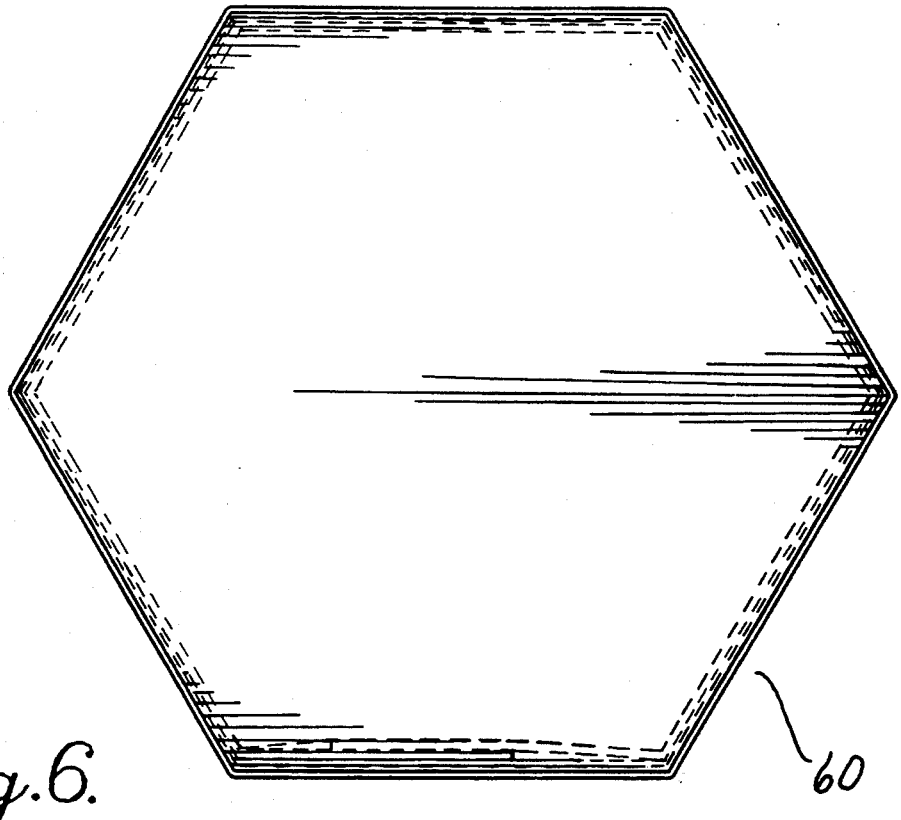
FIG. 6 is a top plan view of a hexagonal embodiment of the container of the present invention.

The first preferred embodiment of a container 10 constructed in accordance with the present invention has been shown as having an overall circular configuration. However, it should be readily apparent to those of skill in the art that other geometric configurations are possible. For example, an alternate container 60 is shown in FIG. 6. Drum 60 is configured and is constructed identically as shown previously for drum 10, except that the hoop is formed to have a generally hexagonal plan configuration. Construction of the hexagonal configuration can be accomplished by bending a wooden strip treated with steam, for example.

Figure 7:
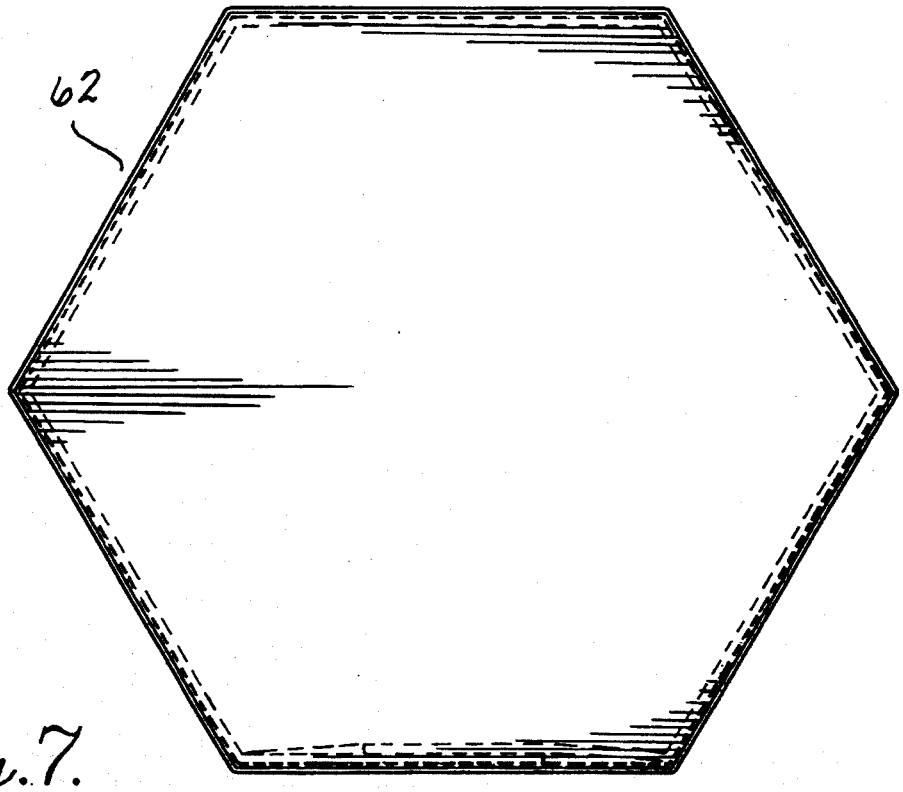
FIG. 7 is an octagonal embodiment of the container of the present invention.

FIG. 7 illustrates a further alternate embodiment of a container 62. The container 62 is constructed identically to container 60, except that it has an octagonal plan configuration.

The process for making the container 10 and packaging of foodstuff 24 or other articles therein will now be described. After the hoop 14 is constructed, as described previously, the membrane 20 is prepared by wetting with a liquid. Preferably, the membrane 20 is soaked in water for a period of approximately 24 hours to render the membrane pliable. The membrane 20 is then stretched tautly over the first open face 16 of the hoop 14.

Figure 8:
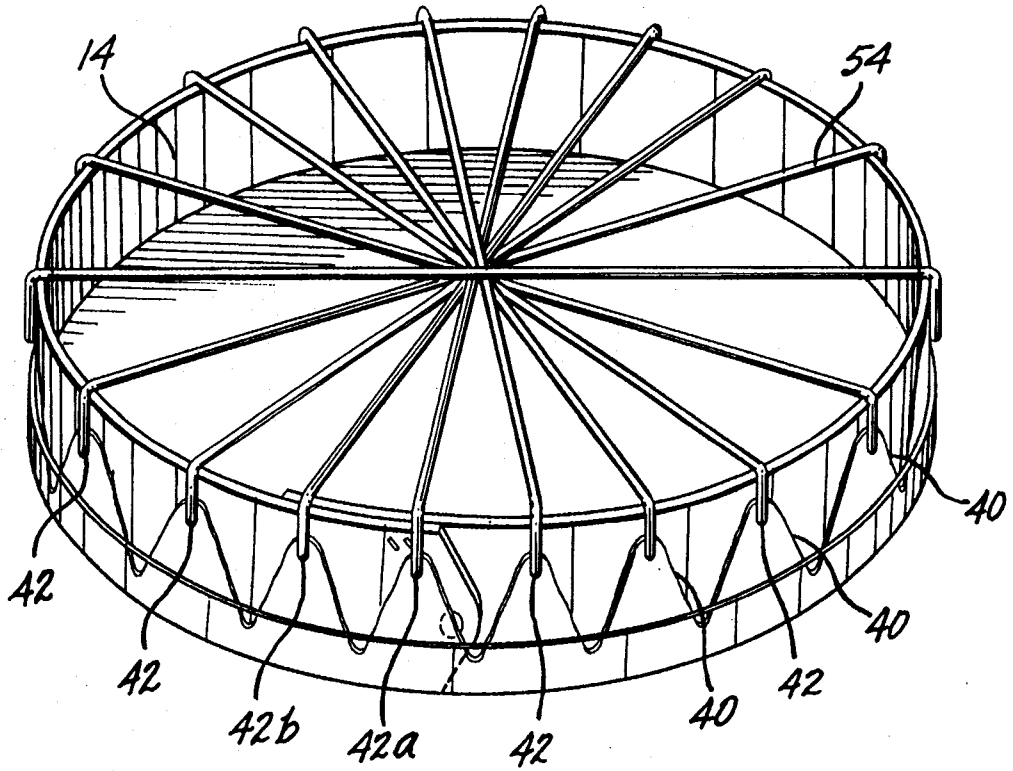
FIG. 8 is a perspective view of the drum portion of the container of FIG. 1, shown during manufacturing with lacing applied to stretch the membrane.

To stretch the membrane 20, it is centered over the hoop 14 to cover the first open face 16. The membrane 20 is then laced tautly in place using a cord 54 passed through the apertures 42 formed in the points 40 of the edge portion 36 of the membrane 20, as shown in FIG. 8. The cord 54 may be formed from deer skin, rawhide, knitted thread, or other suitable material.

The cord 54 is initially threaded through a first aperture **42*a* and is then passed over and across the second open face 18 of the hoop 14 to a diametrically opposed second aperture 42 (not shown). The cord is then returned across the second open face 18 and passed through the next aperture 42*b* adjacent the first aperture 42*a* in the clock-wise, for example, direction. After passing through the aperture 42*b*, the cord is laced through the next diagonally opposed aperture 42, and so forth in a "star" pattern, until all of the apertures 42** are laced and the membrane is drawn taut.

The membrane 20 is then allowed to dry. When deer skin or other leather is used to form the membrane 20, the membrane 20 will shrink as it dries. This shrinking causes the membrane to shrink and tighten, thereby forming a drum head. Additionally, the shrinking imparts the undulating contour to the edge portion 36 of the membrane 20, thereby defining the points 40. After the skin is completely dried, the cord 54 is removed. The overlapping edge portion 36 is then adhered as described previously, and bound with the cord 44.

Foodstuff 24 or other articles are then placed inside the container, and the lid 26 is positioned in place to cover the second open face 18. An external layer of shrink-wrap thermoplastic film is preferably then used to bind the installed lid 26 in place.

The lid 26 may be selectively removed and replaced to allow reuse of the container 10 for storage of articles after initial purchase. Additionally, the lid 26 may be removed to utilize the container 10 as a drum.

While the preferred embodiment of the invention has been illustrated and described, it will be appreciated that various changes can be made therein without departing from the spirit and scope of the invention. It is thus intended that the scope of letters patent granted hereon be limited only by the definitions of the appended claims.

The embodiments of the invention in which an exclusive property or privilege is claimed are defined as follows:

1. An integral container and drum, comprising:

a hoop defining first and second open faces, wherein the hoop comprises an elongate strip wrapped so that the ends of the strip overlap, and securement means for securing the overlapped ends;

a flexible membrane secured tautly and permanently to the hoop to cover the first open face, whereby the flexible membrane serves as a percussion drum head and the hoop and flexible membrane cooperatively define a cavity for receiving articles; and a rigid lid slidably and removably engaged with the hoop for selectively covering the second open face, wherein the lid has a perimeter defining a rim that is dimensioned to be received within the hoop, thereby preventing substantial movement of the lid in a plane defined by the second open face, and wherein the rim of the lid has a contoured portion that accommodates the overlapped ends of the strip forming the hoop to prevent rotation of the lid relative to the hoop.

2. The container and drum of claim 1, wherein the securement means comprises first and second fasteners spaced apart in a direction parallel to the central axis of the hoop.

3. The container and drum of claim 1, wherein the membrane is larger than the width of the first open face, having an edge portion that is folded over an exterior surface of the hoop.

4. The container and drum of claim 3, wherein the edge portion of the membrane is secured to the exterior surface of the hoop with an adhesive.

5. The container and drum of claim 4, further comprising a cord wrapped around the edge portion of the membrane to further secure the membrane to the hoop.

* * * * *